US006401245B1

(12) United States Patent
Slautterback

(10) Patent No.: US 6,401,245 B1
(45) Date of Patent: Jun. 11, 2002

(54) KNEE PAD AND MANUFACTURING METHOD

(75) Inventor: E. Gerald Slautterback, Coral Springs, FL (US)

(73) Assignee: FLA Orthopedics, Inc., Miramar, FL (US)

( * ) Notice: Subject to any disclaimer, the term of this patent is extended or adjusted under 35 U.S.C. 154(b) by 0 days.

(21) Appl. No.: 09/777,577

(22) Filed: Feb. 6, 2001

(51) Int. Cl.[7] ..... A41D 13/00
(52) U.S. Cl. ..... 2/24
(58) Field of Search ..... 2/455, 22, 16, 2/24, 911; 128/881, 882; 602/23, 26, 62–63

(56) References Cited

U.S. PATENT DOCUMENTS 1,404,723 A * 1/1922 Swope ..... 2/24
5,477,559 A * 12/1995 Clement ..... 2/22
5,594,954 A * 1/1997 Huang ..... 2/24
6,178,556 B1 * 1/2001 Foreman et al. ..... 2/22

* cited by examiner

*Primary Examiner*—Gloria M. Hale
*Assistant Examiner*—Tejash Patel
(74) *Attorney, Agent, or Firm*—Dougherty & Clements LLP

(57) ABSTRACT

An improved knee pad for industrial applications that require kneeling, which has an outer shell, an inner cushion pad within the shell, a laminated fabric pad against the inner cushion pad and extending beyond the ends of the shell, the fabric pad being adapted for contacting a wearer; and straps for conforming the knee pad to the shape of the wearer's knee. A method for making the knee pad is also disclosed.

20 Claims, 2 Drawing Sheets

KNEE PAD AND MANUFACTURING METHOD

CROSS REFERENCE TO RELATED APPLICATIONS

This application claims the benefit of U.S. patent application Ser. No. 29/126,080, filed Jul. 7, 2000, and U.S. patent application Ser. No. 29/126,081, filed Jul. 7, 2000.

FIELD OF THE INVENTION

The present invention relates to knee pads for protecting the patella of a human being and to manufacturing methods for such knee pads.

1. Background of the Invention

Industrial kneepads are used in a variety of occupations that require occasional to continuous kneeling. Typical users of kneepads include baggage handlers, carpenters, roofers, tile installers, and carpet layers. Any person who is required to kneel for an extended period of time runs the risk of injuring his or her kneecap (patella). Some of the common knee injuries (Patellar Subluxation, Knee Contusion, and Bursitis, Chrondromalacia Patella Syndrome) are caused by weight, pressure, and twisting at the knee.

Kneepads are designed to reduce the chance of injury and to provide comfort to the user while kneeling. Typical kneepads are big and awkward and have a tendency to migrate down the legs. The most common kneepads are made of a closed cell foam that is cut into shape and placed in a cloth pouch that is attached to a plastic knee cup. Kneepads are usually fastened with elastic or webbing straps. Kneepads provide padding to the knee while the plastic kneecap provides swivel and sliding action, taking friction off the patella.

2 . Description of the Prior Art

Knee pads are known in the prior art, which consists basically of familiar and obvious structural configurations despite a large number of knee pad designs which have been developed to meet various objectives or requirements.

SUMMARY OF THE INVENTION

The present invention is a low-profile, shock absorbent knee pad which offers the patella protection from pressure, weight, and abrasion when kneeling for extended periods.

The invention utilizes two different ploymeric materials to form a knee pad structure. The first material is a pliable yet durable material which form the outer knee shell of the knee pad. The knee shell provides the basic structure of the device. A second, softer material is injected into a recess in the knee shell as an insert. The second, softer material provides a cushioning surface into which the user's knee can sink when in use. No blown foam is used in the invented knee pad.

The preferred material for the knee insert is a thermoplastic elastomer (TPE), and most preferably Santopreneg which is especially formulated to be used in combination with polyamide or polyurethane for applications where hard/soft combinations are required. The preferred material for the knee shell is a Ethylene Vinyl Acetate (EVA), especially formulated for molding flexible articles.

The knee cup and insert are injection molded in a one step process. These materials and processes permit the design of an extraordinarily flexible and thin knee pad.

OBJECTS OF THE INVENTION

The principal object of the present invention is to provide an improved knee pad for use by wearers who are required by their duties to kneel frequently.

A further object of this invention is to provide a method of manufacturing an improved knee pad.

BRIEF DESCRIPTION OF THE DRAWINGS

The foregoing and other objects will become more readily apparent by referring to the following detailed description and the appended drawings in which.

DETAILED DESCRIPTION

Figures 1, 2, 3, 4, 5, 6, 7, 8:
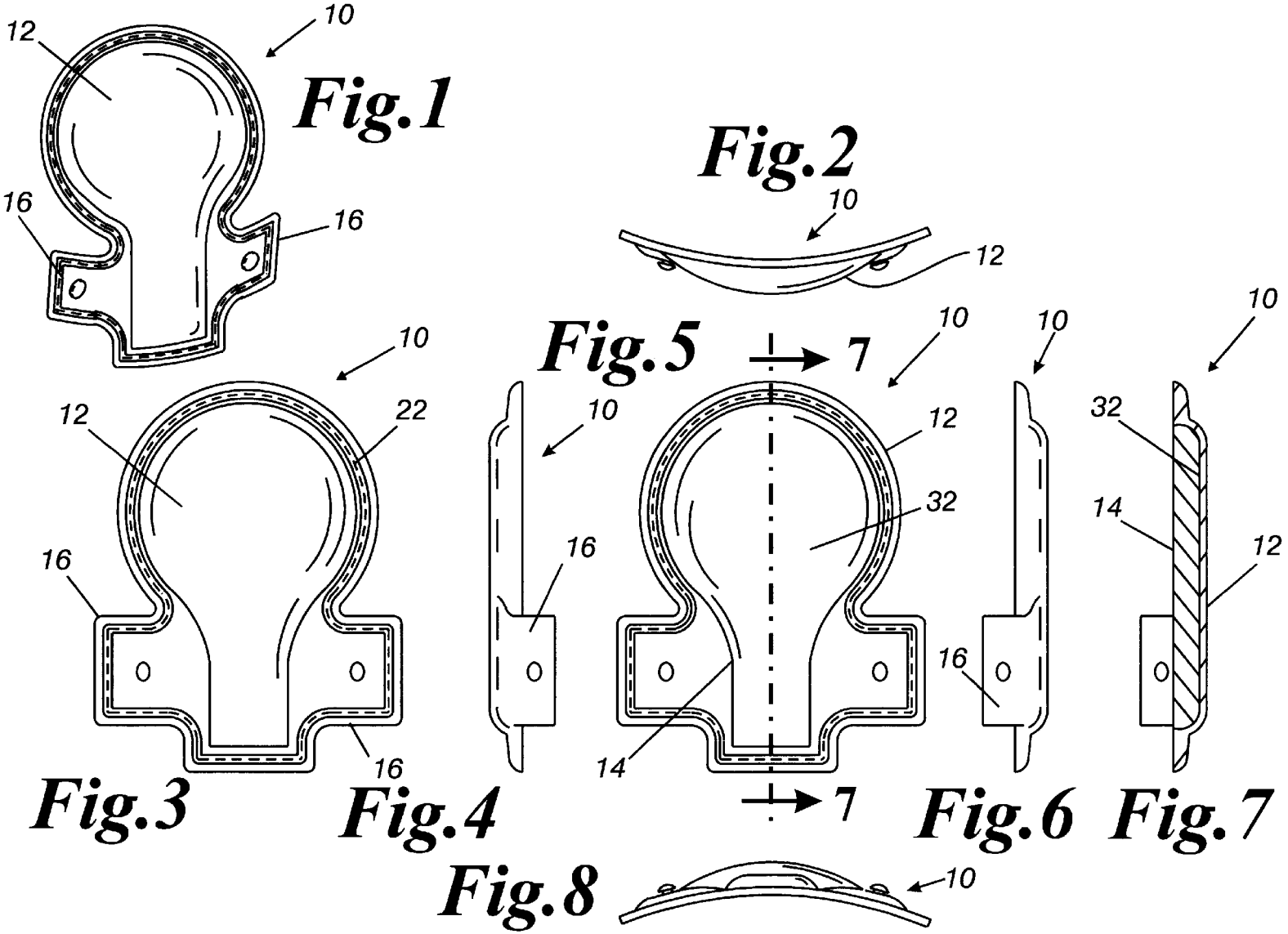
FIG. 1 is a perspective view of a knee cup portion of the invented knee pad.
FIG. 2 is a top view of the knee cup of FIG. 1.
FIG. 3 is a front view of the knee cup.
FIG. 4 is a left side view of the knee cup.
FIG. 5 is a rear view of the knee cup portion showing section 7—7.
FIG. 6 is right side view of the knee cup.
FIG. 7 is a cross-section view of the knee cup taken along line 7—7 of FIG. 5.
FIG. 8 is a bottom view of the knee cup.

Referring now to the drawings, and particularly to FIG. 1, a perspective view of a knee cup portion 10 of the invented knee pad, the outer shell 12 of which is visible in this view. One of the achievements of this invention is a slim profile of the knee cup. The slim profile enables the wearer to walk upright in comfort as well as perform kneeling tasks. The outer shell 12 is achieved by molding a polymer, for example, polyurethane with a pliable surface giving a rubber-like feel. The knee pad shell 12 may be polished in a number of ways depending upon application. For instance, the shell may be produced with a highly polished mold to allow the knee pad to slide, or the shell may be produced with an unpolished mold, which causes the finished shell to have a non-skid surface.

FIGS. 3 and 5 show a front plan view of the knee cup 10. The lower portion of the cup contains two fastening points 16 where straps 20 (FIG. 9), that surround the upper leg and hold the knee in place, are joined. The pliable material permits the shell 12 to conform to the shape of the wearer's knee, insuring no gaps. The knee pad is fabricated in two steps. The knee cup 10, illustrated in FIGS. 1 to 8 is fabricated in a single molding process. A soft cushioning polymer, preferably a thermoplastic elastomer (TPE) such as Santoprene® , or alternatively a urethane based compound or other compound having similar physical properties to Santoprene® is injection molded in a single step that forms the insert 14 shaped to fit the patella and the harder TPE, urethane, polyurethane, polypropylene, nylon, or the like, forming the outer shell 12. The dampening insert material 14, may alternatively be pour molded or lay-in laminated to the outer shell 12.

The durometer of the Santoprene® is adjusted to provide a soft pad 14 that the wearer's knee can deform in such manner that the device is substantially fitted to the individual wearer's patella for comfort and performance under impact. The formed knee cup 10 is joined to the rest of the device by sewing along an indentation 22 along the periphery of the knee cup 10 on the side opposite the insert 14. FIG. 7 is a cross-section view of FIG. 5. The knee cup 10 is shown to be comprised of a polyurethane outer shell 12 and a Santoprenes insert 14. After molding both the outer shell 12 and the insert 14 are pliable. FIGS. 2 and 8 show the concave shape of the cup 10 which is thin compared to existing knee pads. Ethylene Vinyl Acetate is injection molded on both sides to yield a finished appearance.

Figure 9:
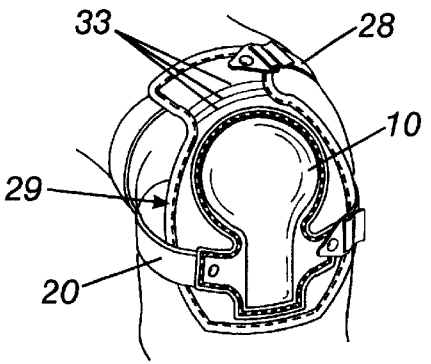
FIG. 9 is a perspective view of the assembled knee pad in place on a bent knee.
Figure 10:
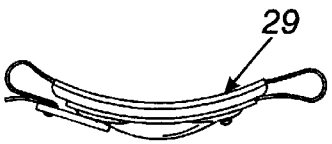
FIG. 10 is a top view of the assembled knee pad.
Figure 11:
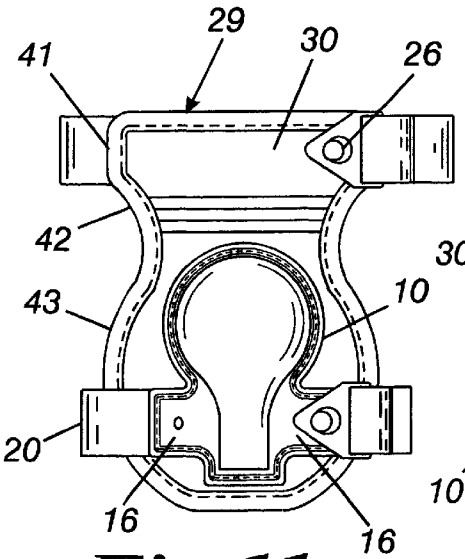
FIG. 11 is a front view of the assembled knee pad.
Figure 12:
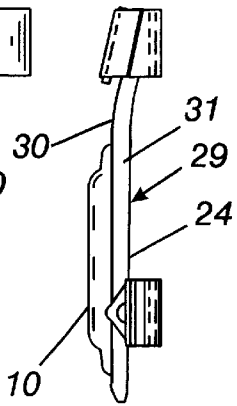
FIG. 12 is a right side view of the assembled knee pad of FIG. 11.
Figure 13:
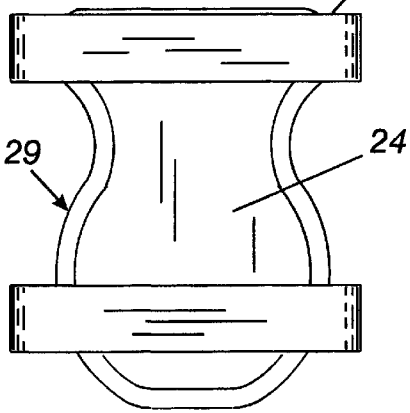
FIG. 13 is a rear view of the invented knee pad, i.e., from the knee side.
Figure 14:
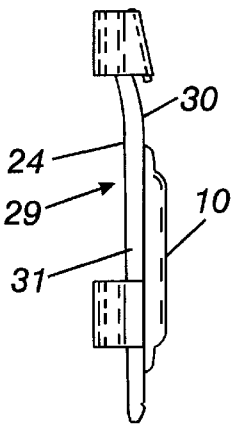
FIG. 14 is a left side view of the assembled knee pad.
Figure 15:
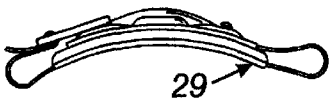
FIG. 15 is a bottom view of the assembled knee pad.

FIGS. 12 and 14 show a cushioning base 29 for placement between the knee cup 10 and wearer and extending outwardly from the knee cup 10. Although not to be so limited, the cushioning base 29 is formed of a pad 31, an inner material 24, and an outer material 30. The cushioning base 29 is affixed to the knee cup 10. The pad 31 is preferably an EVA or urethane foam to provide suitable cushioning and comfort. Alternatively, the pad 31 can be constructed of a specialty open or closed neoprene rubber blends. The outer material 30 preferably laminated to the pad 31 and made of nylon Nylon Cordura, a tough, durable thick canvas like cloth that is stain proof, and holds moisture. Similar high strength materials having properties similar to Cordura may be used in the alternative. The inner material 24 is preferably laminated to the pad 31 for placement against the wearer. Preferably the inner material 24 is flannel: chosen for the softness of flannel which may come in direct contact with the wearer's skin. As illustrated in FIGS. 9 and 11, the outer material 30 is provided with attachment points 26 for sewing a second strap 28 which fits above the wearer's knee.

As illustrated in FIG. 9, a series of grooves 33 are compression formed in the pad 31 between the knee cup 10 and the second strap 28 to form a hinge which allows the knee to easily flex so that the cushioning base 29 flexes in concert with normal knee movement.

Referring now to FIG. 1, the outer shell 12 of knee cup 10, is shown, The outer shell 12 of knee cup 10 has a substantially circular upper portion with a lower portion extending downward therefrom. The lower portion of the outer shell 12 has two extending members which extend opposite of one another, each extending member having a hole therein such that the extending member may be used as a fastening point 16. Referring to FIG. 3, the outer shell 12 defines an indentation 22 along its entire periphery, such indentation being of a depth of approximately one fourth to one half of the thickness of the outer shell 12, with a width approximating its depth. Referring to FIGS. 4 and 6, the extensions which form fastening points 16 are preferably slightly angled backwards.

Referring now to FIGS. 5 and 7, the rear side of outer shell 12 defines rear indentation 32. Rear indentation 32 has a depth equal to one quarter to three quarters the thickness of outer shell 12. Rear indentation 32 has an upper portion which is substantially circular and resides within the substantially circular upper portion of the outer shell 12. The lower portion of rear indentation 32 is an elongate section extending downwards from the rounded upper indentation 32 and is defined by and within the lower section of the rear surface of outer shell 12. Further referring to FIGS. 5 and 7, the inner cushion pad 14, also referred to as the insert 14, is of the same general shape as the rear indentation 32 formed within the rear surface of outer shell 12, and insert 14 substantially fills the rear indentation 32 such that the rear surface of outer shell 12 is even with the rearward facing surface of insert 14.

Referring now to FIGS. 9–15, the cushioning pad 29 is fixedly attached to the knee cup 10 by sewing the cushioning pad 29 to the knee cup 10 along indentation 22 of the knee cup 10. As shown in FIG. 11, the cushioning pad 29 has an upper portion 41 having attachment points 26, a middle portion 42 providing for the hinged movement of the upper portion from the lower portion, and a lower portion 43. The outer surface of the lower portion 43 of the cushioning pad 29 outer fabric pad 30 is sewn directly to the knee cup 10 about indentation 22. As shown in FIG. 1l, the cushioning pad 29 is continuous and covers the rear side of the knee cup 10. Prior to connection to a human leg, the strap 20 is connected from one fastening point 16 to the opposing fastening point 16, and the second strap 28 is connected from one attachment point 26 to the opposing attachment point 26.

SUMMARY OF THE ACHIEVEMENT OF THE OBJECTS OF THE INVENTION

From the foregoing, it is readily apparent that I have invented an improved knee pad for use by wearers who are required by their duties to frequently kneel, and a method of manufacturing such improved knee pad.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A knee pad for protecting the human patella, comprising:

(a) an outer shell constructed of a first polymeric material having a first durometer;

(b) an inner shell pad juxtaposed with said outer shell, said inner shall pad constructed from a second polymeric material having a second durometer, said second duiometer being less than said first durometer;

(c) a pad attached to said outer shell outer shell and extending outwardly from said shell, said pad being adapted for contacting a wearer; and (d) means for conforming said pad and attaching said pad to the wearer's knee.

2. A knee pad for protecting the human patella, comprising:

a shell including:

a concave outer portion constructed of a first polymeric material of a first durometer and having inner and outer surfaces, and an inner portion constructed of a second polymeric material of a second durometer, said second durometer being less than said first durometer, and having inner and outer surfaces wherein said outer surface of said inner portion is juxtaposed with said inner surface of said outer portion such that a gaseous medium is not provided between said inner and outer portions during use;

a pad attached to said shell and extending outwardly from said shell, said pad adapted for conforming about a wearer's knee; and a first attachment means attached to said knee pad for releasable attaching said knee pad to the wearer's knee.

3. The knee pad according to claim 2, wherein said inner portion is compressed between the patella and said outer portion when said knee pad is worn by the wearer, and wherein said outer portion is of a sufficient hardness to be resistant to wear, and wherein said inner portion is of a hardness that is adapted for cushioning and conforming to the contour of the patella of the wearer.

4. The knee pad according to claim 2, wherein said knee pad is configured so that a significant portion of external forces which are applied to said outer portion are dispersed across the patella when worn.

5. The knee pad according to claim 2, wherein said inner and outer portions each include a generally circular upper end and an elongate lower end integral with, and contiguously extending from, said upper end, wherein a rim of said outer portion upper end is configured to generally encircle a patella of a wearer, and wherein said lower end is configured to cover the patellar tendon between the tibia and patella when worn by the wearer.

6. The knee pad according to claim 5, wherein said upper end of said outer portion includes a recess, and wherein said inner portion is at least partially disposed within said recess.

7. The knee pad according to claim 6, wherein said recess has a depth in the range of approximately ¼ to 2 a thickness of said outer portion.

8. The knee pad according to claim 6, wherein said lower end includes a recess which is contiguous with said upper end recess, and wherein said inner portion is substantially disposed within said upper and lower end recesses.

9. The knee pad according to claim 8, wherein said inner portion has the same general shape as said first upper and lower recesses and substantially fills said recesses.

10. The knee pad according to claim 9, wherein said outer surface of said inner portion is generally flush with the inner surface of said outer portion such that said inner portion such that said inner portion does not substaintially extend beyond said recesses.

11. The knee pad according to claim 9, wherein said outer and inner portions are made from a material selected from the group consisting of: TPE, urethane, polyurethane, polypropylene, polyamide, and nylon, and wherein said outer portion is sufficiently pliable to at least partially conform to the wearer, and wherein said inner shell portion conforms to the patella when worn by the wearer.

12. The knee pad according to claim 11, wherein said pad is made from a material selected from the group consisting of: ethylene vinyl acetate foam, urethane foam, or neoprene rubber.

13. The knee pad according to claim 11, wherein the knee pad is configured so that the patella of the wearer partially extends within said upper recess when said knee pad is worn.

14. The knee pad according to claim 8, wherein the inner portion is compressed between the patella and said outer portion and is adapted to conform to the contour of the patella and to the patellar tendon between the tibia and patella of the wearer when worn by the wearer.

15. The knee pad according to claim 14, further including a pair of tabs extending from said lower end of said outer portion and a second attachment means attachable to said tabs for attaching said knee pad to the wearer.

16. The knee pad according to claim 15, wherein said first attachment means is securable around a leg of the wearer above the patella and the second attachment means is securable around the leg of the wearer below the patella.

17. The knee pad according to claim 16, wherein said outer portion is semi-rigid.

18. The knee pad according to claim 17, wherein said outer portion is sufficiently pliably that the tabs conform to the wearer when said second attachment means is secured around the leg of the wearer.

19. The knee pad according to claim 18, wherein a hinge is integrally formed within said pad above said shell, wherein said hinge bends in concert with bending of the wearer's knee such that said knee pad stays at a fixed position on the wearer when in use.

20. The knee pad according to claim 19, wherein said hinge includes a series of generally parallel grooves formed in said pad, and wherein a thickness of said pad at said grooves is less than a thickness of said pad adjacent to said grooves.

* * * * *